US008795586B2

(12) United States Patent
Kawase et al.

(10) Patent No.: US 8,795,586 B2
(45) Date of Patent: Aug. 5, 2014

(54) METHOD OF PRODUCING POWDER SINTERED PRODUCT

(75) Inventors: Kinya Kawase, Niigata (JP); Takashi Nakai, Gosen (JP)

(73) Assignee: Diamet Corporation, Niigata-Shi (JP)

( * ) Notice: Subject to any disclaimer, the term of this patent is extended or adjusted under 35 U.S.C. 154(b) by 1309 days.

(21) Appl. No.: 11/720,585

(22) PCT Filed: Nov. 14, 2005

(86) PCT No.: PCT/JP2005/020805

§ 371 (c)(1),
(2), (4) Date: Jun. 20, 2007

(87) PCT Pub. No.: WO2006/067921

PCT Pub. Date: Jun. 29, 2006

(65) Prior Publication Data

US 2008/0159900 A1 Jul. 3, 2008

(30) Foreign Application Priority Data

Dec. 21, 2004 (JP) ..... 2004-370220

(51) Int. Cl.
*B22F 1/00* (2006.01)

(52) U.S. Cl.
USPC ..... 419/37; 419/32; 419/38

(58) Field of Classification Search
USPC ..... 419/38, 37
See application file for complete search history.

(56) References Cited

U.S. PATENT DOCUMENTS

| | | | | |
|---|---|---|---|---|
| 2,628,080 | A * | 2/1953 | Mack | 366/139 |
| 5,069,714 | A * | 12/1991 | Gosselin | 75/252 |
| 6,537,489 | B2 * | 3/2003 | Allroth et al. | 419/38 |

FOREIGN PATENT DOCUMENTS

| | | | |
|---|---|---|---|
| EP | 1199124 | A1 | 4/2002 |
| JP | 61-136602 | A | 6/1986 |
| JP | 63-072802 | A | 4/1988 |
| JP | 2000-199002 | A | 7/2000 |
| JP | 2000-273502 | A | 10/2000 |
| JP | 2000-273503 | A | 10/2000 |
| JP | 2001-294902 | A | 10/2001 |
| JP | 2001-342478 | A | 12/2001 |
| JP | 2003-105405 | A | 4/2003 |
| JP | 2003-191095 | A | 7/2003 |
| JP | 58-071302 | A | 4/2004 |

OTHER PUBLICATIONS

Y. Ozaki et al., Pre-mixed Partially Alloyed Iron Powder for Warm Compaction: KIP Clean Mix HW Series, Kawasaki Steel Technical Report, No. 47, Dec. 2002, pp. 48-54.
Y. Thomas et al., Influence of Temperature on Properties of Lithium Stearate Lubricant, Metal Powder Report, MPR Publishing Services, vol. 1, No. 3, Jan. 1, 1997, pp. 4-23.

* cited by examiner

*Primary Examiner* — Jessee Roe
*Assistant Examiner* — Christopher Kessler
(74) *Attorney, Agent, or Firm* — Leason Ellis LLP.

(57) ABSTRACT

A sinter of stable quality is produced by molding a powder for powder metallurgy. This process includes successively conducting the following steps: charging a powder and a solid lubricant into a mold compact formation in which the powder charged into the mold is compacted; releasing the compact from the mold; and the powder for powder metallurgy is charged again into the mold after the release step. The temperature of the mold is set at a value in the range of from the boiling point of water to the melting point of the solid lubricant. The compact can be continuously formed without causing, e.g., a failure in the feeding of the powder for powder metallurgy. The sinter obtained by sintering the compact is almost even in strength and density.

4 Claims, 3 Drawing Sheets

METHOD OF PRODUCING POWDER SINTERED PRODUCT

CROSS REFERENCE TO RELATED APPLICATIONS

This is a U.S. national phase application under 35 U.S.C. §371 of International Patent Application No. PCT/JP2005/020805, filed Nov. 14, 2005 and claims the benefit of Japanese Application No. 2004-370220 filed Dec. 21, 2004. The International Application was published in Japanese on Jun. 29, 2006 as International Publication No. WO 2006/067921 under PCT Article 21(2) the content of both which are incorporated herein in its entirety.

TECHNICAL FIELD

The present invention relates to a method of producing a powder sintered product.

BACKGROUND ART

In the past, as an example of these methods, a method of solidifying a powder material (for example, Japanese Unexamined Patent Application, First Publication No. S63-72802) was widely known in which a predetermined amount of water is added to metal powders or the like and then the whole mixture was mixed, charged into a mold equipped with a steam venting means, and subjected to a pressure molding under a low temperature of 100° C. or below in order to increase the apparent density at a low pressure when immobilizing theses kinds of powder materials. It was also widely known that a method of producing an alloyed aluminum sintered compact (for example, Japanese Unexamined Patent Application, First Publication No. S61-136602) in which a rapidly-solidified powder containing an alloyed aluminum is mixed with a lubricant powder having a melting point in the range of 100 to 300° C. to obtain a mixed powder. In this method, the mixed powder is heated at the temperature higher than the melting point of the lubricant powder and then pressured to obtain a powder compact. The powder compact is then sintered in order to obtain both a high-density powder compact and a sintered compact having smaller dimensional variation than the powder compact. Another known method is a method of producing a high-density sintered material in which raw powders such as steel powder or the like are heated under a temperature in the range of 350 to 650° C. in a non-oxidative atmosphere that does not impair the fluidity of the powders. The powders are charged into a mold coated with a lubricant pre-heated at 150 to 450° C., and subjected to compression and a warm molding to mold a powder compact. The powder compact is then heated and sintered in order to obtain a high-density sintered component on the basis that compressibility of the powders are abruptly improved at a temperature around 350° C. regardless of whether the powders are pure iron powders or alloyed steel powders.

In addition, a method of compression-molding a powder for powder metallurgy (Japanese Unexamined Patent Application, First Publication No. 2000-199002) has been widely known in which a powder for powder metallurgy having a lubricant incorporated therein is charged into a mold of which the surface of an inner wall is coated with the lubricant and then the powder is subjected to a compression molding under a warm or a hot atmosphere by setting the content of the lubricant in the powder for powder metallurgy as 0.20% by mass or less (0% by mass not being included in this range) per total mass of the powder in order to increase the molding density when an iron powder or an alloyed iron powder is subjected to the compression molding.

In the case of charging a raw powder for powder metallurgy into a mold and molding a compact by applying pressure under a warm atmosphere, in order to increase the fluidity of the raw powder when charging the raw powder into the mold and in order to increase the compressibility of the compact by increasing the lubricity between the raw powders and between the raw powder and the mold when molding the compact by applying pressure, a raw powder for a warm molding in which lithium stearate is mixed as a lubricant has been generally used as a raw material for powder metallurgy. However, in the case that lithium stearate is mixed in the raw powder, there is a problem in that fluidity of the raw powder is actually deteriorated when the raw powder is heated at 150 (C or higher even though the melting point of lithium stearate is approximately 220 (C. In addition, there is a problem in that sufficient lubricity and compressibility can not be obtained by using lithium stearate.

As disclosed in Japanese Unexamined Patent Application, First Publication No. 2000-273502, it has been known that the fluidity of the raw powder is improved by adding a very small amount of fatty acid metallic salt having a small particle diameter, that is, the average particle diameter to the powder is 4 μm or less. However, there are weak points in that lubricity that can not be obtained by adding a very small amount of fatty acid metallic salt when the pressure molding is carried out, and fluidity is actually deteriorated when the amount thereof sufficient to obtain general lubricity is added. In addition, there is a problem in that the cost for producing fatty acid metallic salt having small particle diameter is more expensive than the cost for producing general fatty acid metallic salt, which is not economical.

As disclosed in Japanese Unexamined Patent Application, First Publication No. 2001-294902, it has been known that a lubricant which contains a component having a low melting point that is lower than the temperature for the pressure molding is used. However, there is a problem in that fluidity of the raw powder can not be sufficiently obtained when the lubricant containing a lubricative component having a low melting point is heated up to the temperature for a warm molding.

For molding a powder compact as mentioned above, a powder for powder metallurgy having a solid lubricant incorporated in a raw powder thereof is charged into a mold by the use of a powder feeding device. The powder for powder metallurgy charged into the mold is then compacted, the powder compact is taken out of the mold, and the powder for powder metallurgy is charged again into the mold from which the powder compact was taken out. These steps are successively carried out to continuously mold the powder compact. The powder feeding device is equipped with a hopper and a feeder connected with a feeding pipe (for example, Japanese Unexamined Patent Application, First Publication No. 2003-191095).

As mentioned above and according to the related arts described in Japanese Unexamined Patent Application, First Publication No. S63-72802, Japanese Unexamined Patent Application, Japanese Unexamined Patent Application, First Publication No. S61-136602, Japanese Unexamined Patent Application, First Publication No. S58-71302, Japanese Unexamined Patent Application, First Publication No. 2000-199002, Japanese Unexamined Patent Application, First Publication No. 2000-273502, Japanese Unexamined Patent Application, First Publication No. 2001-294902, a warm molding is carried out by heating the powder for powder metallurgy before it is charged into the mold or heating the mold where the powder for powder metallurgy is charged into.

SUMMARY OF THE INVENTION

As mentioned above, in the case of heating a powder for powder metallurgy before it is charged into a mold, since a lubricant is softened even when the powder is heated at the temperature of the melting point of the lubricant or below, the powder is hardened in a feeding pipe or a feeder, thereby easily causing failure in charging. In addition, in the case of not heating the powder for powder metallurgy, there is a problem in that a sintered product may be uneven in quality due to a variation in the temperature, that is, an increase in the temperature due to a continuous molding and a decrease in the temperature of the mold when operation of a molding device is stopped because of a failure of the device or for taking a break during the operation.

Therefore, an object of the invention is to provide a method of producing a powder sintered product which allows producing a powder sintered product of stable quality.

The inventors carried out an experiment in which a powder for powder metallurgy having a solid lubricant incorporated in a raw powder thereof was heated in a mold to mold a powder compact. The powder compact was sintered, and it was discovered that unevenness in density of a powder sintered product became larger when the temperature of the mold was below the boiling point of water and unevenness in weight of the powder sintered product became larger when the temperature of the mold was over the melting point of the solid lubricant. Thus the present invention was contrieved.

The invention relates to a method of producing a powder sintered product and the method includes a charging step of charging a powder for powder metallurgy having raw powders and a solid lubricant incorporated therein into a mold; a powder compact molding step of compacting the powder for powder metallurgy charged into the mold and molding a powder compact; and a powder compact release step of taking the powder compact out of the mold; continuously molding the powder compact; and sintering the powder compact, in which the temperature of the mold is set to a value in the range of from the boiling point of water to the melting point of the solid lubricant.

The invention also relates to the above production method in which the raw powder is one of an iron powder, an alloyed iron powder, and a mixed powder containing the iron powder and the alloyed iron powder as main components, the solid lubricant is a hydroxy fatty acid, and the temperature of the mold is in the range of 101 to 190° C.

The invention can also relates to the above production method in which a powder for powder metallurgy is not heated before it is charged.

The invention according to another embodiment relates to the production method in which the temperature of the mold is almost regularly maintained within the range of ±20° C. by heating and cooling the mold in the powder compact molding step.

The invention according to a further embodiment relates to the above production method in which the temperature of the powder for powder metallurgy is maintained at the boiling point of water or below by cooling the powder before it is charged.

According to an embodiment, it is possible to decrease unevenness in the density of a powder compact by setting the temperature of a mold at a value in the range of from the boiling point of water to the melting point of the solid lubricant. Therefore, a sintered product which the powder compact is sintered is substantially even in strength and density.

According to another embodiment, it is possible to obtain a sintered product which is substantially even in strength and density when an iron powder, an alloyed iron powder, or a mixed powder containing the iron powder and the alloyed iron powder as main components is used as a raw powder, particularly, it is possible to obtain excellent lubricity and compressibility in a compression molding greater than the case where the known lithium stearate is used.

According to a further embodiment, since the solid lubricant is not heated before it is charged, the solid lubricant is not melted and thus charging property is not deteriorated. Therefore, evenness in weight and charging density can be obtained.

According to another embodiment, it is possible to obtain a sintered product which is even in strength and density.

According to an embodiment, since the powder for powder metallurgy before being charged may receive heat from the mold when the mold is heated, it is possible to decrease unevenness in the charging of the raw powder by cooling the powder for powder metallurgy before it is charged.

DETAILED DESCRIPTION OF THE INVENTION

Figure 1:
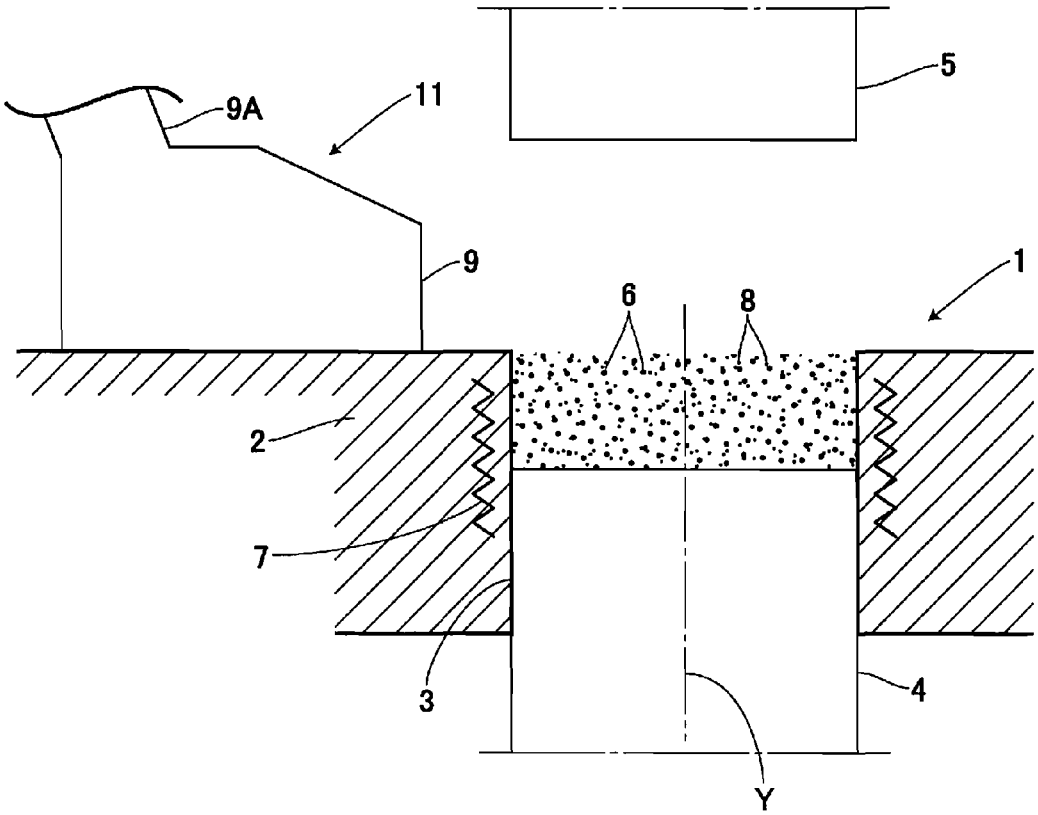
FIG. 1 is a cross-section drawing of a first step illustrating Embodiment 1 of the invention.
Figure 2:
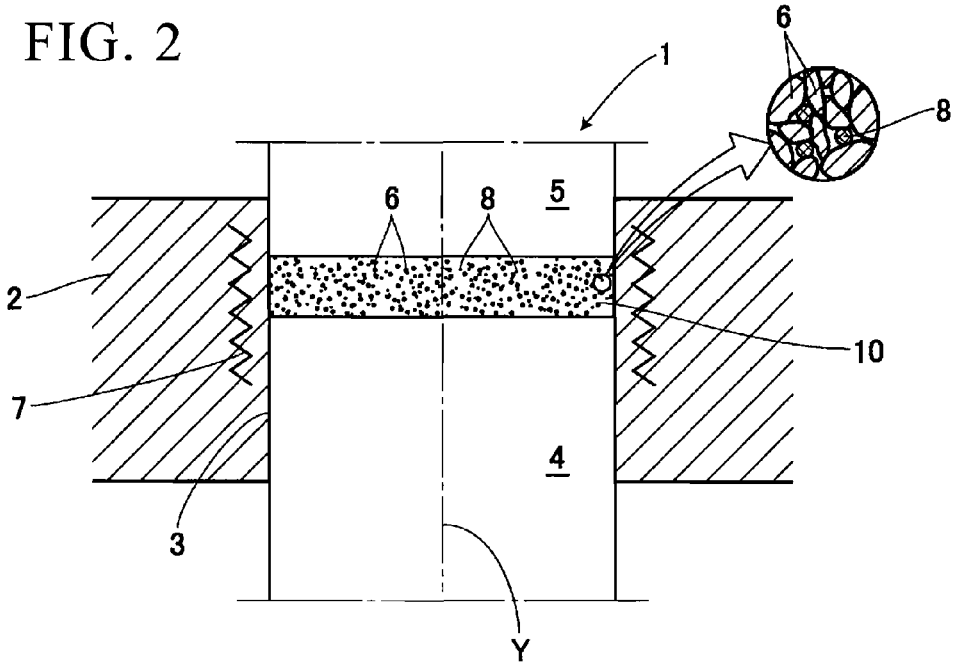
FIG. 2 is a cross-section drawing of a second step illustrating Embodiment 1 of the invention.

Embodiments according to the present invention will be described in detail with reference to the attached drawings. The embodiments described below do not limit contents of the present invention described in the claims. Further, it may not be considered that the whole constitutions described below are necessary requirements for the present invention. In each embodiment, a new method of producing a powder sintered product may be obtained by employing a different method of producing a powder sintered product, and each method of producing a powder sintered product will be described.

Embodiment 1

Hereinafter, Embodiment 1 of the invention will be described with reference to FIGS. 1 to 6. First, a production method will be described with reference to FIGS. 1 and 2. In the drawings, the reference numeral 2 is a die substantially working as a mold having a through-hole 3 on an axis line Y; a bottom punch 4 fitted into the through-hole 3 is disposed below the die 2 for swinging vertically; and a top punch 5 fitted into the through-hole 3 is disposed above the die 2 for swinging vertically.

As mentioned above, a mold 1 includes the die 2, the top punch 5, and the bottom punch 4.

In the die 2, a heating means 7 such as an electric heater which heats the die 2 and a pure iron powder 6 which is a raw powder described later stored in the die 2 is provided.

In a feeder 9 in which the raw powder is fed from a hose 9A thereto in the air and the powder is slid on the upper surface of the die 2 and which drops the raw powder stored therein into the through-hole 3, a mixture of the pure iron powder 6 and a solid lubricant 8, which is of room temperature (20° C.) or a temperature slightly higher than that of room temperature due to remaining heat in the heating means 7, is stored. As the feeder 9 moves forward, the mixture of the powder 6 and the solid lubricant 8 is dropped into and stored in the through-hole 3 in a state where the bottom punch 4 is previously engaged (charging step). An example of the solid lubricant 8 includes hydroxy stearate (more specifically, lithium 12-hydroxy stearate). The mixing ratio of the pure iron powder 6 and the solid lubricant 7 is 100 to 1. At this time, the inner surface of the through-hole 3 is heated by the heating means 7 to 150° C. which is a temperature in the range below the melting point of the solid lubricant. Accordingly, powders 6 and the solid lubricant 8, which are in sides of the inner surface and the axis line Y, are heated to 150° C. The powder 6 of the raw powder may be one of an iron powder, an alloyed iron powder, and a mixed powder containing either or both of the iron powder or/and the alloyed iron powder as the main components.

A powder feeding means 11 is constituted with the feeder 9, the hose 9A, and a hopper (not shown) connected with an edge anchor side of the hose 9A. The mixture of the powder 6 and the solid lubricant 8 is stored inside of the hopper.

Next, the pure iron powder 6 is subjected to a compression molding to form a powder compact 10 by fitting the top punch 5 into the through-hole 3 (powder compact molding step). According to a mechanism of compression molding, the powder 6 stored in the through-hole 3 is rearranged in a first step. At this time, because the powder 6 and the solid lubricant 8 are heated, the solid lubricant 8 is mixed into the powders 6 and thus it becomes a state where the charging property thereof is increased as compared with a rearrangement state at the room temperature where a powder compact is formed at the room temperature even the ratio thereof was the same. As mentioned above, after the first step where the powder 6 is rearranged, the top punch 5 is pressurized into the through-hole 3 as a second step and the powder 6 is plastic-deformed. As a result, a ring-shaped powder compact 10 is formed. Then, the top punch 5 is ejected upwardly and the bottom punch 4 is elevated, thereby taking the powder compact 10 out of the through-hole 3 (powder compact release step).

As mentioned above, in the steps of producing the powder compact 10, a powder for powder metallurgy having the powder 6 of the raw powder in which the solid lubricant 8 is incorporated is charged into the mold 1 (charging step), the powder for powder metallurgy charged into the mold 1 is compressed to mold the powder compact 10 (powder compact molding step), the powder compact 10 is taken out of the mold 1 (powder compact release step), the step of charging the powder for powder metallurgy into the mold 1 again after the powder compact release step is successively carried out to continuously form the powder compact 10.

As mentioned above, in the steps of producing the powder compact 10, the powder for powder metallurgy having the powder 6 of the raw powder in which the solid lubricant 8 is incorporated is not heated before it is charged except for receiving heat from the mold 1. When the powder for powder metallurgy of which the temperature is lower than the temperature of the mold 1 is charged into the mold 1, the temperature of the mold 1 (the temperature of the inner surface of the die 2 and the upper surface of the bottom punch 4) fluctuates. However, the temperature of the mold is maintained at the temperature in the range of ±20° C. from 150° C., which is the setting temperature in this embodiment, by controlling the heating temperature of the heating means 7 by the use of a temperature sensor, which is not shown, in the die 2. The temperature sensor controls the heating temperature of the heating means 7 at the time of charging the powder for powder metallurgy, or cools the die 2 with water. The temperature of the inner surface of the die 2 is detected by the temperature sensor.

The powder compact 10 obtained by the steps of producing the powder compact is sintered under a predetermined gas atmosphere.

Figure 3:
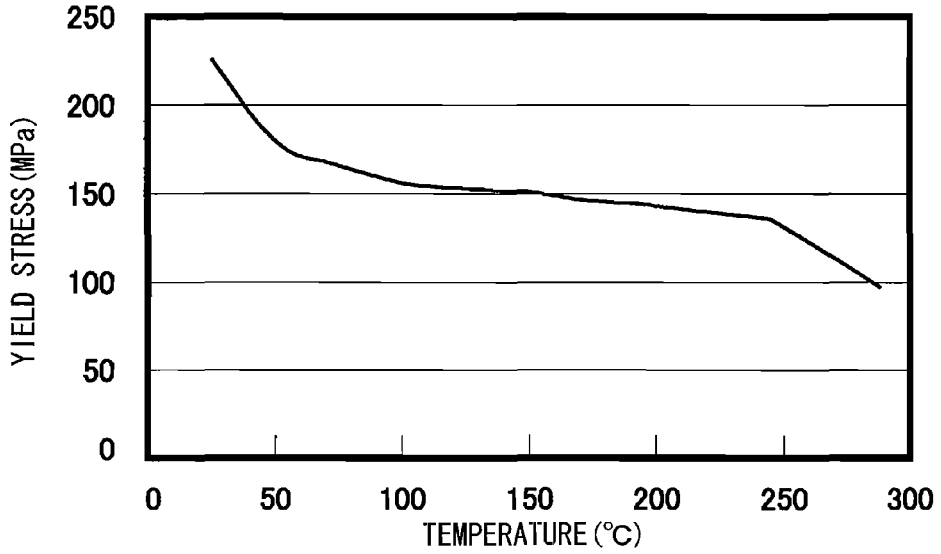
FIG. 3 is a graph showing temperature-dependency of a deformation resistance illustrating Embodiment 1 of the invention.
Figure 4:
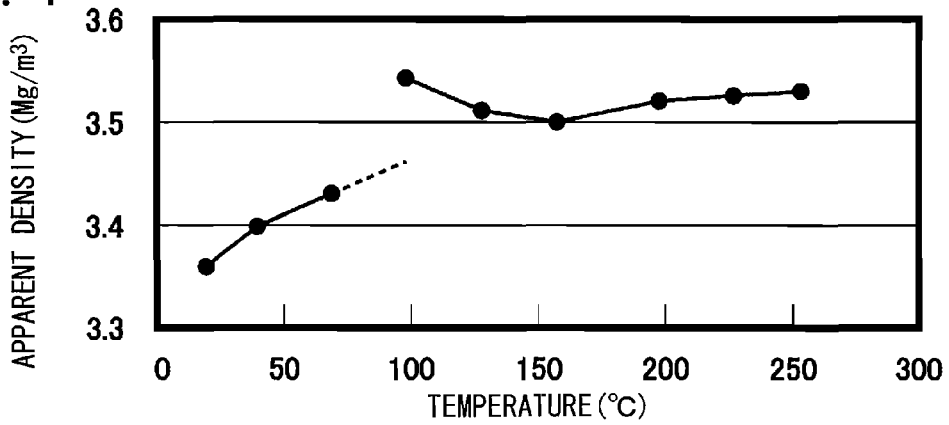
FIG. 4 is a graph of temperature and apparent density illustrating Embodiment 1 of the invention.
Figure 5:
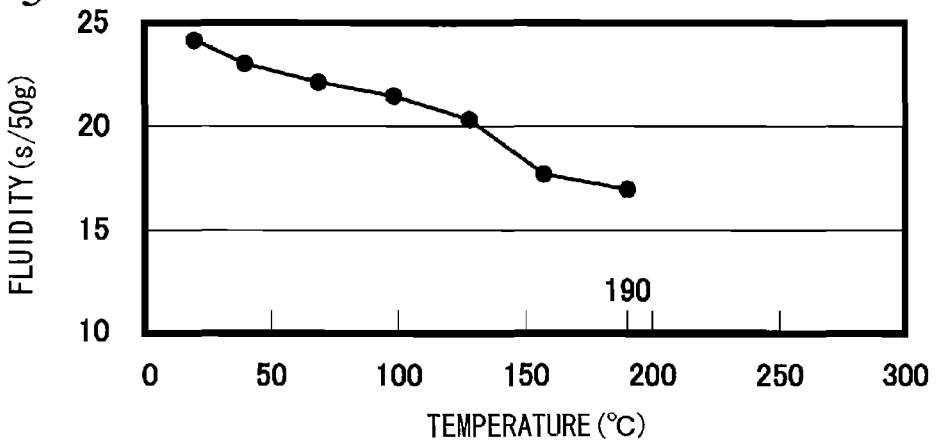
FIG. 5 is a graph of temperature and fluidity illustrating Embodiment 1 of the invention.

FIG. 3 shows the temperature dependency on yield stress of a pure iron (Fe). It can be understood that yield stress of a sintered product becomes generally even from the boundary of 100° C., a substantially even yield stress is obtained in the temperature of the mold 1 in the range of from 100° C. to 200° C., and the yield stress is increased below 100° C. and decreased over 200° C. FIG. 4 is a graph of the temperature and apparent density. The apparent density extremely changes from the boundary of 100° C. and a substantially even apparent density can be obtained in the range of from 100° C. to 200° C. The apparent density is increased from the boundary of 100° C. but becomes even in the range of from 101° C. to 250° C. This range is where the strength (yield stress) and apparent density with respect to the temperature becomes stable. A sintered product which is a substantially even in strength and density can be obtained by heating the mold 1 to the temperature in the range of from 101° C. to 190° C. This range of from 101° C. to 190° C. is the temperature range from the boiling point of water to the melting point of the solid lubricant. FIG. 5 is a graph of temperature and fluidity. Fluidity is generally increased according to an increase in the temperature but the powders do not flow over 200° C.

Next, a suitable example of the solid lubricant 8 used in the invention will be described in detail.

According to the solid lubricant 8 described below, fluidity of the raw powder is not deteriorated when the powder is heated to 150° C. or higher, and it is possible to obtain excellent lubricity and compressibility in a compression molding greater than the case where the known lithium stearate was used. Lithium 12-hydroxy stearate having an average particle diameter of 5 μm to 100 μm can be easily produced according to a method of directly reacting 12-hydroxy stearate derived from castor oil which is inexpensive and a lithium compound, and is highly economical. Therefore, it is advantageous in that the production cost thereof can be reduced.

The powder for powder metallurgy contains hydroxy fatty acid salt having an average particle diameter of 5 μm to 100 μm. Here, the average particle diameter means a particle size measured according to a known method such as a microscopy method, a precipitation method, a laser diffraction scattering method, a laser Doppler method, or the like.

Provided that the average particle diameter of hydroxy fatty acid salt is below 5 μm, fluidity of the raw powder is deteriorated when the hydroxy fatty acid is added to the powder in an amount that general lubricity of the raw powder can be obtained. Accordingly, it is not preferable that the average particle diameter of hydroxy fatty acid salt be below 5 μm.

To produce hydroxy fatty acid salt having small diameter below 5 μm of the average particle diameter in consideration of fluidity, a method of reacting alkali metal salt of hydroxy fatty acid and inorganic metal salt in a wet type is generally used. However, since the water-soluble starting material is a sodium salt or potassium salt of the hydroxy fatty acid, the hydroxy fatty acid salt of lithium having ionizing property higher than that of sodium and potassium can not be produced. According to the invention as described below, it is not preferable that the average particle diameter of hydroxy fatty acid salt be below 5 μm in order to suitably use the hydroxy fatty acid salt of lithium.

When the average particle diameter of hydroxy fatty acid salt is over 100 μm, a large hole is formed in the powder compact after hydroxy fatty acid salt is removed by heat decomposition or evaporation thereof during the sintering. Appearance or mechanical strength of the powder metallurgy product thus obtained is deteriorated. Therefore, it is not preferable that the average particle diameter of hydroxy fatty acid salt be over 100 μm.

The powder for powder metallurgy suitable for the present invention contains hydroxyl fatty acid salt in the amount of 0.3% by mass to 2% by mass. When the content of hydroxyl fatty acid salt is below 0.3% by mass, sufficient lubricity of the raw powder can not be obtained. Accordingly, it is not preferable to give the content of hydroxyl fatty acid salt below 0.3% by mass. In addition, when the content of hydroxyl fatty acid salt is over 2% by mass, compressibility is deteriorated and thus there is no point in the warm molding. Accordingly it is not preferable for the content of hydroxyl fatty acid salt be over 2% by mass. Further, when the content of hydroxyl fatty acid salt is in the range of 0.3% by mass to 0.5% by mass, lubricity may not be obtained depending on the size of the product or surface condition of the mold. Therefore, it is more preferable to contain hydroxyl fatty acid salt in the amount of from 0.5% by mass to 2% by mass.

The powder for powder metallurgy of the present preset invention does not contain a lubricant having the melting point below the molding temperature, Here, the molding temperature means the temperature of the mold 1. When the molding temperature is below 100° C., unevenness in density of the powder compact is increased. When the warm molding temperature is over 190° C., fluidity of the lubricant 8 of the present invention is deteriorated and the raw powder may be oxidized. Therefore, in consideration of the lubricant 8, it is preferable that the molding temperature be set in the range of 101° C. to 190° C., Accordingly, the meaning of "a lubricant having a melting point below the molding temperature is not contained in the present invention" is that the lubricant of which adhesion is increased according to dissolution at the temperature below the molding temperature or variation in a crystal structure is not contained except for the inevitable impurities. Since the lubricant 17 having the melting point below the molding temperature is not contained, the lubricant 8 is not melted and the raw powder is not disturbed even when it is heated up to the molding temperature or more.

Examples of hydroxy fatty acid salt of the present invention include metal salt of hydroxy fatty acid in which a hydroxyl group is added to stearic acid ($C_{17}H_{35}COOH$), oleic acid ($C_{17}H_{33}COOH$), linoleic acid ($C_{17}H_{31}COOH$), linolenic acid ($C_{17}H_{29}COOH$), palmitinic acid ($C_{15}H_{31}COOH$), myristic acid ($C_{13}H_{27}COOH$), lauric acid ($C_{11}H_{23}COOH$), capric acid ($C_9H_{19}COOH$), caprylic acid ($C_7H_{15}COOH$), caproic acid ($C_5H_{11}COOH$), or the like. In addition, hydroxy fatty acid salt having various numbers of carbon atoms or structures may be used. Hydroxy stearate salt is suitably used in consideration of the melting point of hydroxy fatty acid salt, lubricity, and economical property.

Examples of metal constituting hydroxy stearate salt include lithium, calcium, zinc, magnesium, barium, sodium, potassium, and the like. However, lithium is suitably used in consideration of the melting point of hydroxy stearate salt or hygroscopicity. Therefore, in the present invention, lithium hydroxy stearate is suitably used as for hydroxy stearate salt.

Lithium hydroxy stearate having a hydroxy group in a predetermined location or with a predetermined number may be used. However, in consideration of economical efficiency, lithium 12-hydroxy stearate ($CH_3(CH_2)_5CH(OH)(CH_2)_{10}COOLi$) having one hydroxy group in a location of 12th carbon is suitably used. Lithium 12-hydroxy stearate having the average particle diameter of 5 μm to 100 μm can be easily produced according to the method of directly reacting 12-hydroxy stearate ($CH_3(CH_2)_5CH(OH)(CH_2)_{10}COOH$) derived from ricinoleic acid ($CH_3(CH_2)_5CH(OH)CH_2CH{=}CH(CH_2)_7COOH$) which is a main component of inexpensive castor oil and a lithium compound, and is highly economical. Accordingly, the production cost in powder metallurgy can be reduced by using lithium 12-hydroxy stearate. Approximately 10 percent of lithium stearate is mixed therein as the inevitable impurities derived from castor oil. However, since fluidity may be deteriorated when purity of lithium 12-hydroxy stearate is low, it is preferable to have as high purity as possible.

To the powder 15 of the raw powder in powder metallurgy in which, for example, metal such as iron is a main component, hydroxy fatty acid salt is added as the lubricant 17 and then mixed by the use of a rotating mixer or the like to obtain a powder for powder metallurgy.

Here, as mentioned above, the content of hydroxy fatty acid in the powder for powder metallurgy is in the range of from 0.3% by mass to 2% by mass, preferably from 0.5% by mass to 2% by mass in order to obtain lubricity and fluidity of the raw powder. A lubricant having a melting point below the molding temperature is not added. However, a lubricant having a melting point over the molding temperature may be added. As for hydroxy fatty acid salt, hydroxy stearate salt is preferable and lithium hydroxy stearate is more preferable. Among the kinds of lithium hydroxy stearate, lithium 12-hydroxy stearate is most preferred.

In order to improve lubricity of the mold and the raw powder, a powder of hydroxy fatty acid salt may be previously attached on a molding surface of the mold 1 before the powder for powder metallurgy is charged therein. In case of attaching the powder of hydroxy fatty acid salt on the mold 1, the powder can be simply attached by using static electricity after electrifying the powder. As for hydroxy fatty acid salt in such a case, it is preferable to use hydroxy stearate salt, more preferably lithium hydroxy stearate, and most preferably lithium 12-hydroxy stearate by the same reason as the above-mentioned case of the powder for powder metallurgy.

As for hydroxy fatty acid salt attached to the mold 1, hydroxy fatty acid salt having the average particle diameter of 50 μm or below is used. When the average particle diameter of hydroxy fatty acid salt is over 50 μm, the amount of hydroxy fatty acid salt to be attached to the mold becomes oversupplied and surface density of the compact is deteriorated, which is not preferable.

After that, a powder metallurgy product can be obtained by being subjected to a cutting process, if necessary.

As described above in detail, the powder for powder metallurgy of the present invention contains hydroxy fatty acid salt having the average particle diameter of 5 μm to 100 μm in the amount of 0.3% by mass to 2% by mass, more preferably from 0.5% by mass to 2% by mass in the raw powder for powder metallurgy. Therefore, fluidity of the powder 6 of the raw powder is not deteriorated when the powder is heated between 150 and 190° C. and it is possible to obtain excellent lubricity and compressibility in a compression molding greater than the case where the known lithium stearate was used. In addition, since the lubricant 8 having the melting point below the warm molding temperature is not contained in the powder, deterioration in fluidity of the raw powder can be certainly prevented.

According to the warm molding method of the present invention, the molding may be carried out after previously attaching hydroxy fatty acid salt having an average particle diameter of 50 μm or below on the mold 1 for powder metallurgy. Therefore, lubricity of the mold 1 and the raw powder may be increased.

Lithium 12-hydroxy stearate having the average particle diameter of 5 μm to 100 μm can be easily produced according to the method of directly reacting 12-hydroxy stearate derived from inexpensive castor oil and a lithium compound, and is highly economical. Therefore, in order to decrease the production cost, the lithium 12-hydroxy stearate is particularly suitably used as hydroxy fatty acid salt.

As mentioned above, for the powder for powder metallurgy, it is preferable to contain hydroxy fatty acid salt having the average particle diameter of 5 μm to 100 μm in the amount of 0.3% by mass to 2% by mass in the powder 6 of the raw powder. In addition, the powder 6 of the raw powder for powder metallurgy contains hydroxy fatty acid salt having the average particle diameter of 5 μm to 100 μm in the amount of 0.5% by mass to 2% by mass. Further, the lubricant having the melting point below the warm molding temperature is not contained in the powder.

The hydroxy fatty acid salt is hydroxy stearate salt. The hydroxy stearate salt is lithium hydroxy stearate. The lithium hydroxy stearate is lithium 12-hydroxy stearate.

In addition, the warm molding is carried out by using the powder for powder metallurgy. The molding may be carried out after previously attaching hydroxy fatty acid salt having an average particle diameter of 50 μm or below on the mold 1 for powder metallurgy. The hydroxy fatty acid salt is lithium hydroxy fatty acid. The lithium hydroxy fatty acid is lithium hydroxy stearate. It is preferable to use lithium 12-hydroxy stearate as the lithium hydroxy stearate.

As mentioned above, according to an embodiment, the method of producing a powder sintered product includes the charging step of charging the powder for powder metallurgy having the powder 6 of the raw powder and the solid lubricant 8 incorporated therein into the mold 1; the powder compact molding step of compacting the powder for powder metallurgy charged into the mold 1 and molding the powder compact 10; the powder compact release step of taking the powder compact 10 out of the mold 1; continuously molding the powder compact 10; and sintering the powder compact 10, in which the temperature of the mold is set to a value in the range of from the boiling point of water to the melting point of the solid lubricant 8. Therefore, the powder compact 10 can be continuously molded without causing a failure in the feeding of the powder for powder metallurgy. The sintered product which is formed by sintering the powder compact 10 becomes even in strength and density and thus a stable sintered product which is substantially even in strength and density can be produced.

As mentioned above, according to another embodiment, the raw powder is one of an iron powder, an alloyed iron powder, and a mixed powder containing the iron powder and the alloyed iron powder as the main components. That is, the raw powder is one of an iron powder, an alloyed iron powder, and a mixed powder containing either or both the iron powder or/and the alloyed iron powder as the main components. The solid lubricant 8 is hydroxy fatty acid. The temperature of the mold 1 is in the range of 101 to 190° C. therefore it is possible to obtain a sintered product which is even in strength and density when the iron powder or the alloyed iron powder is used as the raw powder and it is possible to obtain excellent lubricity and compressibility in the compression molding greater than the case where the known lithium stearate is used.

As mentioned above, according to a further, since the powder for powder metallurgy is not heated before it is charged, the solid lubricant 8 is not melted and thus the charging property is not deteriorated. Therefore, only the temperature of the mold 1 is required to be controlled.

As mentioned above, in steps of producing the powder compact 10 according to an embodiment, since the temperature of the mold 1 is substantially evenly maintained in the range of ±20° C., it is possible to obtain a sintered product which is even in strength and density.

Embodiment 2

Figure 6:
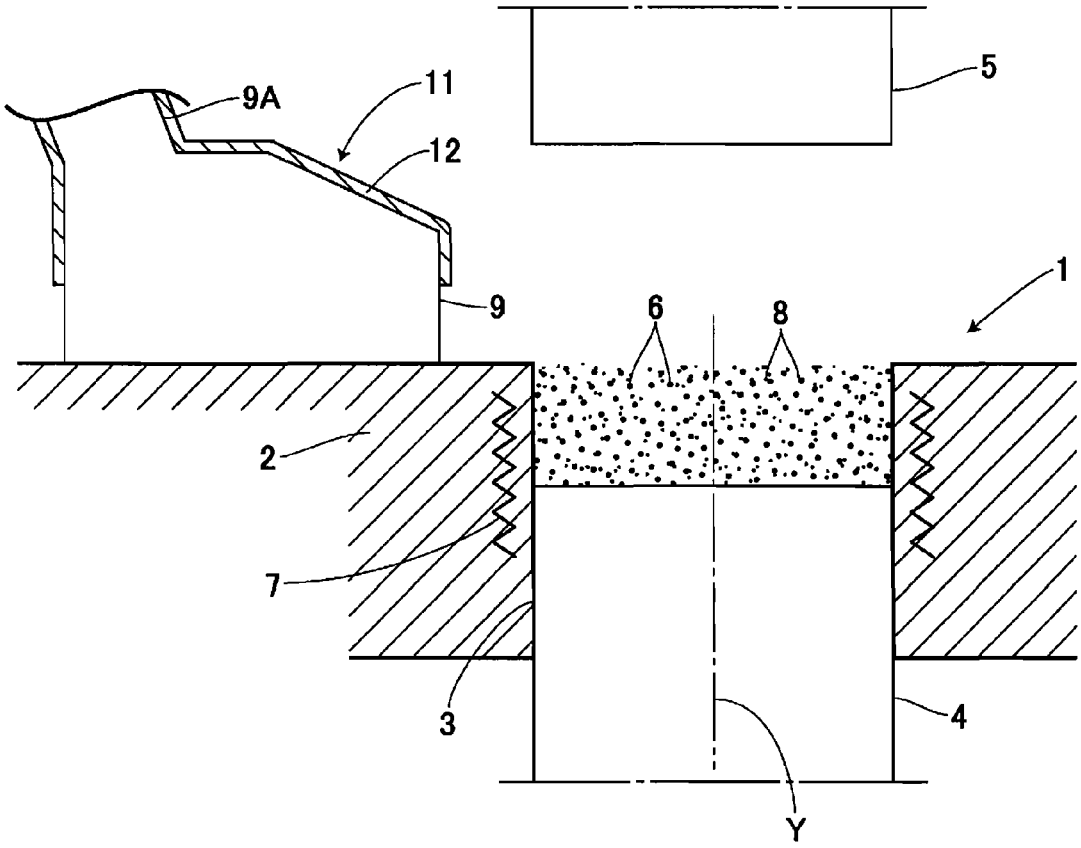
FIG. 6 is a cross-section drawing illustrating Embodiment 2 of the invention.

FIG. 6 indicates an Embodiment 2 of the present invention. With respect to the portions that are the same as those of Embodiment 1, the same reference numerals are assigned detailed descriptions thereof are omitted. The embodiment will be described in detail below. In the embodiment, a cooling means 12 cooling the powder for powder metallurgy before being charged is provided. The cooling means 12 is provided in the powder feeding means 11. The cooling means 12 may use water cooling or air cooling. For a water cooling method, there is a method of circulating a cooling solution. The cooling means 12 is provided in the feeder 9 and the hose 9A, specifically, in a portion of the hose 9A near the mold 1 and outer side of the feeder 9.

Since the mixture of the pure iron powder 6 and the solid lubricant 8, which is the powder for powder metallurgy, may be in the state of high temperature due to remaining heat of the heating means 7 in the feeder 9, the powder for powder metallurgy before being charged is cooled to maintain the temperature thereof below the boiling point of water by the cooling means 12.

As mentioned above, according to an embodiment corresponding to claim 5, the temperature of the powder for powder metallurgy is maintained at the boiling point of water or below by cooling the powder before it is charged. Since the powder for powder metallurgy before being charged can receive heat from the mold 1 when the mold 1 is heated, it is possible to decrease unevenness in charging density by cooling the powder for powder metallurgy before it is charged. In particular, it is preferable to cool the powder to a temperature below the boiling point of water.

The invention is not limited to the above-mentioned embodiment but may be modified in various forms.

The invention claimed is:

1. A method of producing a powder sintered product, consisting of the steps of:

mixing a raw powder and a solid lubricant so as to form a powder for powder metallurgy;

charging the powder for powder metallurgy having the raw powder and the solid lubricant incorporated therein into a mold;

compacting the powder for powder metallurgy charged into the mold and molding a powder compact while heating the mold to a temperature in a range of 101 to 190° C.;

releasing the powder compact out of the mold; and continuously molding the powder compact and sintering the powder compact, wherein the temperature of the mold is set to a value in the range of the boiling point of water or more to the melting point of the solid lubricant or less, and during a period after the raw powder and the solid lubricant are mixed to form the powder for powder metallurgy and before the powder for powder metallurgy is charged into the mold, the powder for powder metallurgy is cooled with a cooling device in which a cooling solution is circulated so as to maintain the temperature of the powder for powder metallurgy within a range of the boiling point of water or below in a situation where the mold is heated to a temperature in a range of 101 to 190° C. and the powder for powder metallurgy receives heat from the mold.

2. The method of producing a powder sintered product according to claim 1, wherein the raw powder is one of an iron powder, an alloyed iron powder, and a mixed powder containing the iron powder and the alloyed iron powder as main components, the solid lubricant is hydroxy fatty acid, and the temperature of the mold is in the range of 101 to 190° C.

3. The method of producing a powder sintered product according to claim 1, wherein the powder for powder metallurgy is not heated before it is charged.

4. The method of producing a powder sintered product according to claim 1, wherein the temperature of the mold is maintained within the range of ±20° C. from a setting temperature by heating and cooling the mold in the powder compact molding step.

* * * * *